US010233900B2

(12) United States Patent
Kawabata

(10) Patent No.: US 10,233,900 B2
(45) Date of Patent: Mar. 19, 2019

(54) HYDRAULIC MOTOR SYSTEM

(71) Applicant: KAYABA INDUSTRY CO., LTD., Tokyo (JP)

(72) Inventor: Kaori Kawabata, Kanagawa (JP)

(73) Assignee: KYB Corporation, Tokyo (JP)

( * ) Notice: Subject to any disclaimer, the term of this patent is extended or adjusted under 35 U.S.C. 154(b) by 318 days.

(21) Appl. No.: 14/372,942

(22) PCT Filed: Feb. 14, 2013

(86) PCT No.: PCT/JP2013/053497
§ 371 (c)(1),
(2) Date: Jul. 17, 2014

(87) PCT Pub. No.: WO2013/125432
PCT Pub. Date: Aug. 29, 2013

(65) Prior Publication Data

US 2015/0000512 A1 Jan. 1, 2015

(30) Foreign Application Priority Data

Feb. 22, 2012 (JP) ..... 2012-036218

(51) Int. Cl.
*F03C 1/06* (2006.01)
*F01B 1/06* (2006.01)
(Continued)

(52) U.S. Cl.
CPC ..... *F03C 1/0663* (2013.01); *F01B 1/0672* (2013.01); *F01B 3/007* (2013.01);
(Continued)

(58) Field of Classification Search
CPC .... F03C 1/0663; F03C 1/0655; F03C 1/0657; F03C 1/066; F03C 1/0636; F03C 1/0686;
(Continued)

(56) References Cited

U.S. PATENT DOCUMENTS 2,961,829 A 11/1960 Weisenbach
3,089,426 A * 5/1963 Budzich ..... F01B 3/0041 91/485

(Continued)

FOREIGN PATENT DOCUMENTS

DE 4303380 A1 8/1994
JP H04-024673 U 2/1992

(Continued)

OTHER PUBLICATIONS

Extended European Search Report dated Nov. 4, 2015.

*Primary Examiner* — Kenneth J Hansen
(74) *Attorney, Agent, or Firm* — Rabin & Berdo, P.C.

(57) ABSTRACT

A hydraulic motor includes a motor mechanism that rotates by hydraulic liquid that is supplied/discharged from a hydraulic liquid pressure source through one of a first motor passage and a second motor passage. The hydraulic motor comprises a casing that defines a casing chamber which accommodates the motor mechanism, and a flushing passage that is in communication with the casing chamber and extracts a portion of the hydraulic liquid from a low pressure side among the first motor passage and the second motor passage and leads it to the casing chamber.

6 Claims, 6 Drawing Sheets

(51) Int. Cl.

| | |
|---|---|
| ***F03C 1/34*** | (2006.01) |
| ***F04B 1/20*** | (2006.01) |
| ***F03C 1/40*** | (2006.01) |
| ***F01B 3/00*** | (2006.01) |

(52) U.S. Cl.
CPC ..... *F03C 1/0644* (2013.01); *F03C 1/0655* (2013.01); *F03C 1/0665* (2013.01); *F03C 1/0697* (2013.01); *F04B 1/2035* (2013.01)

(58) Field of Classification Search
CPC .... F03C 1/0644; F03C 1/0678; F03C 1/0681; F04B 1/2064; F04B 1/2014; F04B 1/2042; F04B 53/04; F01B 1/0612; F01B 1/0672; F01B 1/0064
See application file for complete search history.

(56) References Cited

U.S. PATENT DOCUMENTS

| | | | | |
|---|---|---|---|---|
| 3,181,477 | A * | 5/1965 | Matthews | F01B 3/0041 91/272 |
| 5,419,130 | A | 5/1995 | Ruckgauer et al. | |
| 2002/0112474 | A1 | 8/2002 | Bigo et al. | |
| 2004/0000142 | A1 | 1/2004 | Nunomura | |
| 2004/0187491 | A1 * | 9/2004 | Whitaker | F04B 1/145 60/476 |
| 2005/0252204 | A1 * | 11/2005 | Sekiguchi | F03C 1/0644 60/435 |
| 2007/0017219 | A1 * | 1/2007 | Niidome | F04B 49/002 60/444 |
| 2012/0024145 | A1 | 2/2012 | Mori | |

FOREIGN PATENT DOCUMENTS

| | | | |
|---|---|---|---|
| JP | 2002098034 | A | 4/2002 |
| JP | 2002-327705 | A | 11/2002 |
| JP | 2004-060508 | A | 2/2004 |
| JP | 2004-125092 | A | 4/2004 |
| JP | 2006-161453 | A | 6/2006 |
| JP | 2009299531 | A | 12/2009 |
| JP | 4540750 | B1 | 9/2010 |
| KR | 10-2011-0119739 | A | 11/2011 |

* cited by examiner

HYDRAULIC MOTOR SYSTEM

TECHNICAL FIELD

The present invention relates to a hydraulic motor that rotates by hydraulic liquid pressure.

BACKGROUND ART

A hydraulic motor system that is installed as a travel device in a hydraulic shovel, a road roller, or the like includes a hydraulic motor mechanism that rotates by hydraulic liquid pressure and a reduction gear that reduces the speed of rotation of the motor mechanism to drive a wheel (drum).

In a piston motor including such a reduction gear, the temperature of the reduction gear rises when continuously operating at high speed, and a casing which accommodates the motor mechanism is also heated due to the rising temperature of the reduction gear.

In the piston motor disclosed in JP2004-60508A, hydraulic oil that has leaked out from the motor mechanism (leak oil) flows into the casing, and the casing is cooled by the hydraulic oil.

In the piston motor disclosed in JP2006-161753A, a portion of the hydraulic oil that drives a capacity-varying mechanism flows into the casing, and the casing is cooled by the hydraulic oil.

SUMMARY OF INVENTION

However, in the piston motor disclosed in JP2004-60508A, the flow amount of leak oil that flows into the casing from the motor mechanism is small. Thus, the cooling of the casing may be insufficient.

In the piston motor disclosed in JP2006-161753A, the hydraulic oil pressure that is led to the capacity-varying mechanism is switched by a speed switching valve (flow amount control valve) that switches the traveling speed. Therefore, when the hydraulic oil pressure is switched to low, the flow amount of hydraulic oil that flows into the casing is reduced, and thus the cooling of the casing may be insufficient.

The present invention was created in consideration of the above-described problems, and an object thereof is to provide a hydraulic motor in which a casing is sufficiently cooled regardless of the operating conditions.

According to one aspect of this invention, a hydraulic motor equipped with a motor mechanism that is configured to rotate by hydraulic liquid that is supplied/discharged from a hydraulic liquid pressure source through one of a first motor passage and a second motor passage, includes: a casing that defines a casing chamber which accommodates the motor mechanism, and a flushing passage that is in communication with the casing chamber and extracts a portion of the hydraulic liquid from a low pressure side among the first motor passage and the second motor passage and leads it to the casing chamber.

The details as well as other features and advantages of this invention are set forth in the remainder of the specification and are shown in the accompanying drawings.

DESCRIPTION OF EMBODIMENTS

Figure 1:
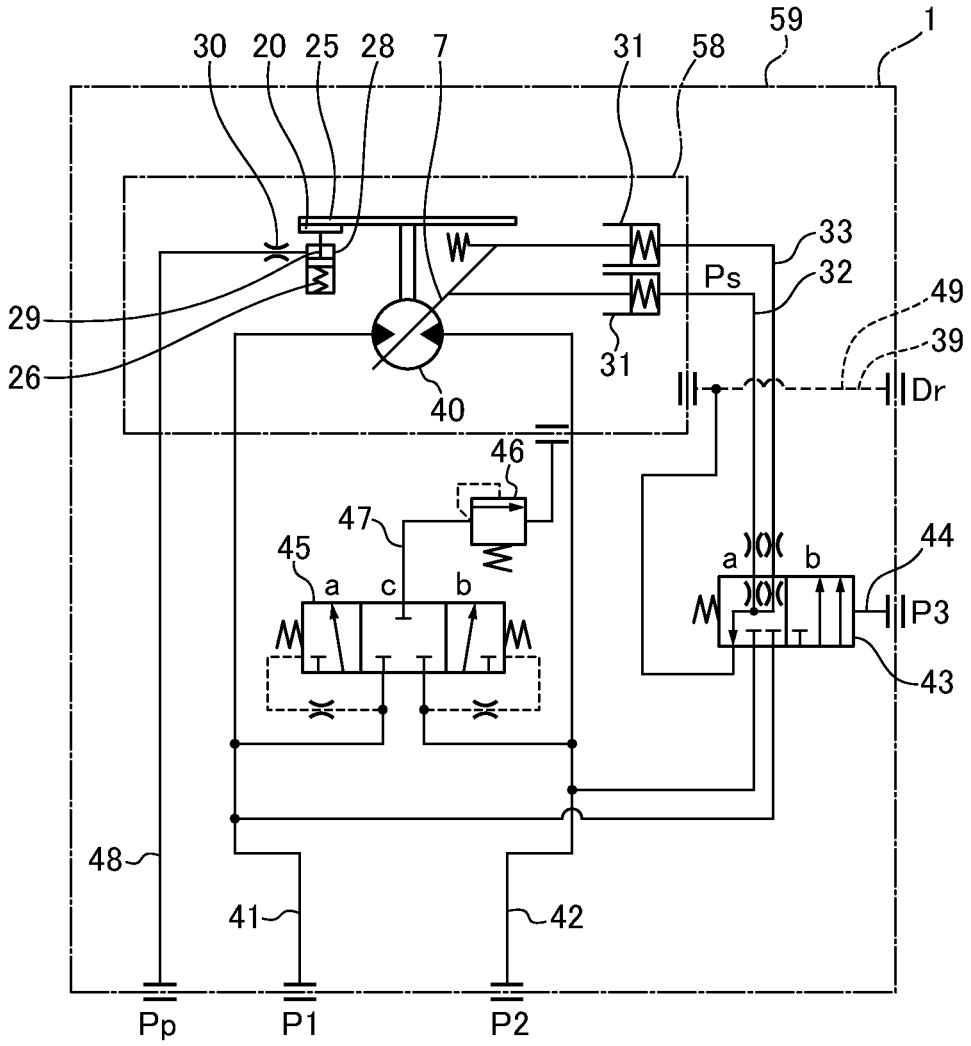
FIG. 1 is an oil pressure circuit diagram of a piston motor illustrating an embodiment of the present invention.

An embodiment of the present invention will now be explained below referring to the drawings.

FIGS. 1 to 7 illustrate a piston motor 1 that constitutes a travel device of a vehicle as one example of a hydraulic motor system to which the present invention is applied.

For example, in a road roller, a hydraulic shovel, or the like, a hydrostatic transmission device (HST) is installed to transmit motive power of the engine to the travel device by hydraulic oil pressure. The hydrostatic transmission device includes a variable capacity-type piston pump (not illustrated) as an oil pressure source that is driven by the engine and a variable capacity-type piston motor 1 as a hydraulic motor that drives a wheel. In the hydrostatic transmission device, hydraulic oil circulates between the piston pump and the piston motor 1.

In the piston motor 1, hydraulic oil is used as the hydraulic fluid. Instead of hydraulic oil, for example, a hydraulic liquid such as an aqueous alternative liquid can be used.

FIG. 1 is a diagram of an oil pressure circuit provided in the piston motor 1. As shown in FIG. 1, the piston motor 1 includes a motor mechanism 40, also referred to in the present specification and claims as a hydraulic motor 40, that rotates by hydraulic oil pressure, and first and second motor passages 41 and 42 that supply/discharge hydraulic oil to and from the hydraulic motor 40. The first and second motor passages 41 and 42 are connected to an oil pressure source (not illustrated) and constitute a closed circuit of the hydrostatic transmission device.

The piston motor 1 rotates in a counter-clockwise direction when a pressure P1 of hydraulic oil that is led from the oil pressure source to the first motor passage 41 is increased more than a pressure P2 of hydraulic oil that is led to the second motor passage 42.

On the other hand, the piston motor 1 rotates in a clockwise direction when a pressure P2 of hydraulic oil that is led from the oil pressure source to the second motor passage 42 is increased more than a pressure P1 of hydraulic oil that is led to the first motor passage 41.

The piston motor 1 includes a pair of tilting actuators 31 as a capacity-varying mechanism that changes the capacity (displacement volume) of the motor mechanism 40. The tilting actuators 31 operate by hydraulic oil pressure that is led through an actuator passage 32 and an actuator passage 33.

The piston motor 1 includes a speed switching valve 43 that switches the hydraulic oil pressure that is led to the tilting actuators 31. The speed switching valve 43 includes a low speed position a in which the actuator passage 32 and the actuator passage 33 are in communication with an in-motor drain passage 49, and a high speed position b in which the actuator passage 32 and the actuator passage 33 are in respective communication with the first and second motor passages 41 and 42.

Hydraulic oil pressure discharged from a charge pump (not illustrated) provided to the oil pressure source is led to the speed switching valve 43 via a speed switching pilot pressure passage 44. The oil pressure of hydraulic oil that is led via the speed switching pilot pressure passage 44 is a pilot pressure P3 that switches the speed switching valve 43 between the positions a and b.

The charge pump provided to the oil pressure source is driven by the engine or the like.

During operation in which the pilot pressure P3 is low, the speed switching valve 43 is switched to the low speed position a. Thereby, a drain pressure Dr is led to the tilting actuators 31 via the in-motor drain passage 49. If the sum of a propulsive force by the drain pressure Dr and a propulsive force by a two-speed spring 23 (refer to FIG. 2) becomes lower than a propulsive force by a hydraulic pressure of pistons 6 (refer to FIG. 2) that is transmitted through a swash plate 7 (refer to FIG. 2) or the like, the tilting actuators 31 are drawn in. Thus, the capacity of the motor mechanism 40 increases.

During operation in which the pilot pressure P3 rises above a predetermined value, the speed switching valve 43 is switched to the high speed position b. Thereby, motor drive pressures P1 and P2 are respectively led from the first and second motor passages 41 and 42 to the tilting actuators 31. The tilting actuators 31 elongate due to the motor drive pressure P1 or P2. Thus, the tilt angle of the swash plate 7 (refer to FIG. 2) decreases, and the capacity of the motor mechanism 40 decreases.

The piston motor 1 includes a parking brake 20 that automatically brakes the motor mechanism 40 from rotating due to an external force after travel of the vehicle has been stopped. The parking brake 20 includes a brake mechanism 25 that brakes the rotation of the motor mechanism 40 by a biasing force of a brake spring 26 when stopping the rotation of the motor mechanism 40, and a brake release actuator 29 that releases the braking of the brake mechanism 25 when actuating the rotation of the motor mechanism 40.

The brake release actuator 29 operates by a brake release pressure Pp that is led from a brake release pressure passage 48 to a brake release pressure chamber 28. Hydraulic oil pressure that is discharged from the charge pump provided to the oil pressure source is led to the brake release pressure passage 48. The brake release pressure passage 48 is not limited to the above constitution, and it can be constituted such that hydraulic oil that is discharged from a piston pump that constitutes the hydrostatic transmission device provided to the oil pressure source is led to the brake release pressure passage 48. The brake release pressure passage 48 can also be constituted such that a tank pressure and oil pressure from the oil pressure source are selectively led via a switching valve (not illustrated).

A restrictor 30 is interposed in the brake release pressure passage 48. Pressure fluctuations in the brake release pressure chamber 28 are alleviated by the restrictor 30.

When stopping the travel of the vehicle, the brake release pressure Pp that is led to the brake release pressure passage 48 decreases, and the brake mechanism 25 brakes the rotation of the motor mechanism 40 after stopping by the biasing force of the brake spring 26.

On the other hand, when the vehicle is traveling, the brake release pressure Pp is increased, and the brake release actuator 29 operates in a constricting direction to counter the biasing force of the brake spring 26 so that the braking of the brake mechanism 25 is released.

In a casing 59 of the piston motor 1, a casing chamber 58 is provided to accommodate the motor mechanism 40 and the parking brake 20.

Hydraulic oil (leak oil) that leaks out from the motor mechanism 40 and the brake mechanism 25 flows into the casing chamber 58. In order to return the hydraulic oil that has leaked out to a tank, a drain passage 39 is provided to connect the casing chamber 58 with the tank. As the drain passage 39, the in-motor drain passage 49 that is formed in the casing 59 and an out-of-motor drain passage (not illustrated) that is connected to the casing 59 are provided.

An oil cooler (not illustrated) that cools the hydraulic oil and an oil filter (not illustrated) that filters the hydraulic oil are interposed in the out-of-motor drain passage. By cooling the hydraulic oil with the oil cooler, the hydraulic oil which is stored in the tank can be maintained at a lower temperature than that of the hydraulic oil that circulates through the first and second motor passages 41 and 42.

In order to cool the hydraulic oil that circulates through the closed circuit connecting the motor mechanism 40 and the oil pressure source, a flushing passage 47 is connected to the first and second motor passages 41 and 42 via a low pressure selective valve 45. A relief valve 46 is interposed in the flushing passage 47.

The low pressure selective valve 45 includes a position a in which the second motor passage 42 is connected to the flushing passage 47, a position b in which the first motor passage 41 is connected to the flushing passage 47, and a position c in which communication between the first and second motor passages 41 and 42 and the flushing passage 47 is blocked. The low pressure selective valve 45 is switched according to a pressure difference of the first and second motor passages 41 and 42.

During normal rotation of the piston motor 1 in which the pressure of the first motor passage 41 rises above the pressure of the second motor passage 42 exceeding a predetermined value, the low pressure selective valve 45 is switched to position a.

On the other hand, during reverse rotation of the piston motor 1 in which the pressure of the second motor passage 42 rises above the pressure of the first motor passage 41 exceeding a predetermined value, the low pressure selective valve 45 is switched to position b.

In this way, a portion of the hydraulic oil that flows through the low pressure side of the first and second motor passages 41 and 42 is extracted from the flushing passage 47 via the low pressure selective valve 45. The relief valve 46 opens and this hydraulic oil is returned from the flushing passage 47 to the tank through the in-motor drain passage 49 and the out-of-motor drain passage.

Heat is discharged from the hydraulic oil that is returned to the tank through the out-of-motor drain passage by the oil cooler interposed in the out-of-motor drain passage. Thereby, the hydraulic oil stored in the tank can be maintained at a low temperature.

The oil pressure source (not illustrated) is configured to charge hydraulic oil suctioned from the tank by the charge pump into the closed circuit (the first and second motor passages 41 and 42) of the motor mechanism 40. Thereby, hydraulic oil at a relatively low temperature is replenished from the tank into the first and second motor passages 41 and 42. Thus, temperature increases in the hydraulic oil that circulates through the motor mechanism 40 are suppressed.

In the travel device of the vehicle, a reduction gear is provided adjacent to the casing 59 of the piston motor 1, and the reduction gear reduces the speed of the rotation of the motor mechanism 40 to drive a wheel (drum) (not illustrated). In a travel device installed in a road roller vehicle or the like, if the piston motor 1 is continuously operated to rotate at high speed, the temperature of the reduction gear rises and the casing 59 of the piston motor 1 is heated by the reduction gear. Thus, it is necessary to ensure that a bearing 17 and an oil seal 37 (refer to FIG. 2) interposed in the casing 59 are not overheated.

In contrast, in the present embodiment, the flushing passage 47 is connected to the casing chamber 58 that accommodates the motor mechanism 40 of the piston motor 1, and hydraulic oil that flows out from the flushing passage 47 is led to the casing chamber 58.

Hydraulic oil that flows out from the flushing passage 47 circulates through the casing chamber 58 and absorbs heat of the casing 59 so as to cool the casing 59.

By cooling the casing 59 as described above, the reduction gear that is adjacent to the casing 59 can also be cooled, and thus temperature increases of the reduction gear are suppressed.

In accordance with the rotation of the motor mechanism 40, a portion of the hydraulic oil is extracted from the low pressure side of the first and second motor passages 41 and 42 to the flushing passage 47. Therefore, the flow amount of hydraulic oil that flows from the flushing passage 47 to the casing chamber 58 when the motor mechanism 40 is rotating is sufficiently secured. Thus, the casing 59 is sufficiently cooled regardless of the operating conditions of the piston motor 1.

The specific constitution of the piston motor 1 will be explained below referring to FIGS. 2 to 7.

Figure 2:
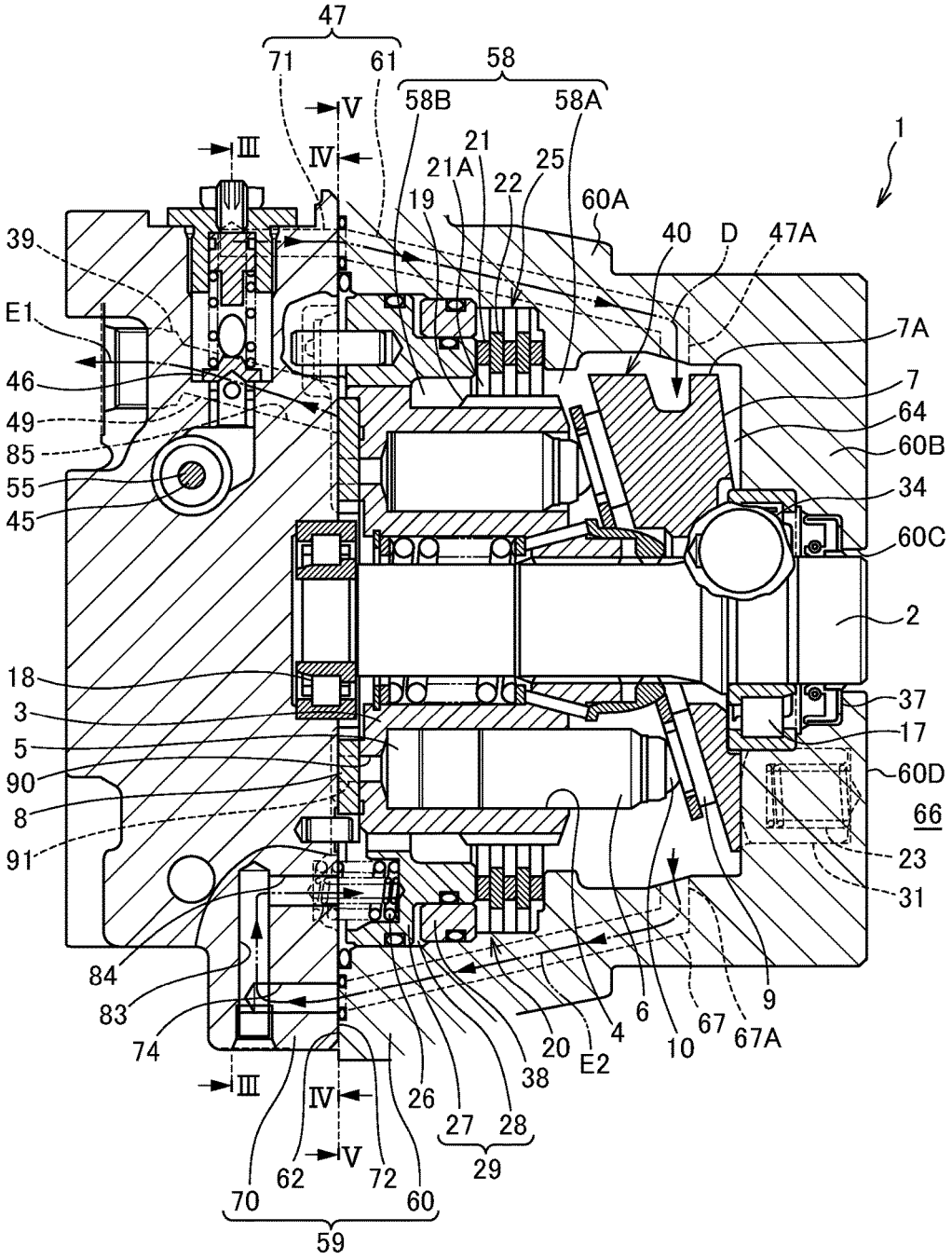
FIG. 2 is a vertical cross-section view of a piston motor.

FIG. 2 is a vertical cross-section view of the piston motor 1. As shown in FIG. 2, the piston motor 1 includes a case 60 and a base plate 70 as the casing 59. The casing chamber 58 is defined between the case 60 and the base plate 70. The motor mechanism 40 and the parking brake 20 are accommodated in the casing chamber 58.

In the piston motor 1, one end of an output shaft 2 is rotatably supported on the case 60 via a bearing 17, and the other end of the output shaft 2 is rotatably supported on the base plate 70 via a bearing 18.

The case 60 includes a cylinder-shaped case side part 60A and a disc-shaped case bottom part 60B. A case opening part 60C is formed at the center of the case bottom part 60B. One end of the output shaft 2 faces the case opening part 60C. An input shaft of the reduction gear is connected to one end of the output shaft 2 so that the motive power of the output shaft 2 is extracted. The oil seal 37 is interposed between the case opening part 60C and the output shaft 2. The casing chamber 58 is sealed by the oil seal 37.

The motor mechanism 40 includes the output shaft 2 and a cylinder block 3 that rotates integrally with the output shaft 2. A plurality of cylinders 4 are formed on the cylinder block 3. The cylinders 4 extend parallel to the output shaft 2, and are arranged approximately concyclically centered on the output shaft 2. A piston 6 is inserted into each cylinder 4, and a volume chamber 5 is defined between each cylinder 4 and piston 6.

A shoe 9 is movably connected via a spherical seat 10 to the tip of each piston 6. In accordance with the rotation of the cylinder block 3, each shoe 9 slidingly contacts the swash plate 7, and each piston 6 moves back and forth in a stroke amount according to a tilt angle of the swash plate 7.

A valve plate 8 is interposed between the case 60 and the base plate 70. The valve plate 8 includes two ports 91 that are in communication with the oil pressure source (not illustrated). A port 90 (refer to FIG. 5) that is in communication with each volume chamber 5 opens at an end surface of the cylinder block 3. The pistons 6 protrude from the cylinders 4 by hydraulic oil pressure led from the oil pressure source to the volume chambers 5 via the ports 91 and 90, and the pistons 6 push the swash plate 7 via the shoes 9 to rotate the cylinder block 3.

A pair of balls (support shafts) 34 that tiltingly support the swash plate 7 at the center of a tilting axis and a pair of tilting actuators 31 that compress the back surface side of the swash plate 7 are provided on the case bottom part 60B.

When a pilot pressure Ps that is led to the tilting actuators 31 is low, the swash plate 7 is retained in a heavily tilted position (state shown in FIG. 1) by the resultant force of a compressing force generated from the pistons 6. When the swash plate 7 is in the heavily tilted position, the stroke amount of the pistons 6 increases. Thus, the output shaft 2 rotates at a low speed with a high torque.

If one of the pilot pressure Ps that is led to the tilting actuators 31 is increased, the swash plate 7 is tilted due to compression by the tilting actuators 31 and is switched to a slightly tilted position. When the swash plate 7 is in the slightly tilted position, the stroke amount of the pistons 6 decreases. Thus, the output shaft 2 rotates at a high speed with a low torque.

Figure 3:
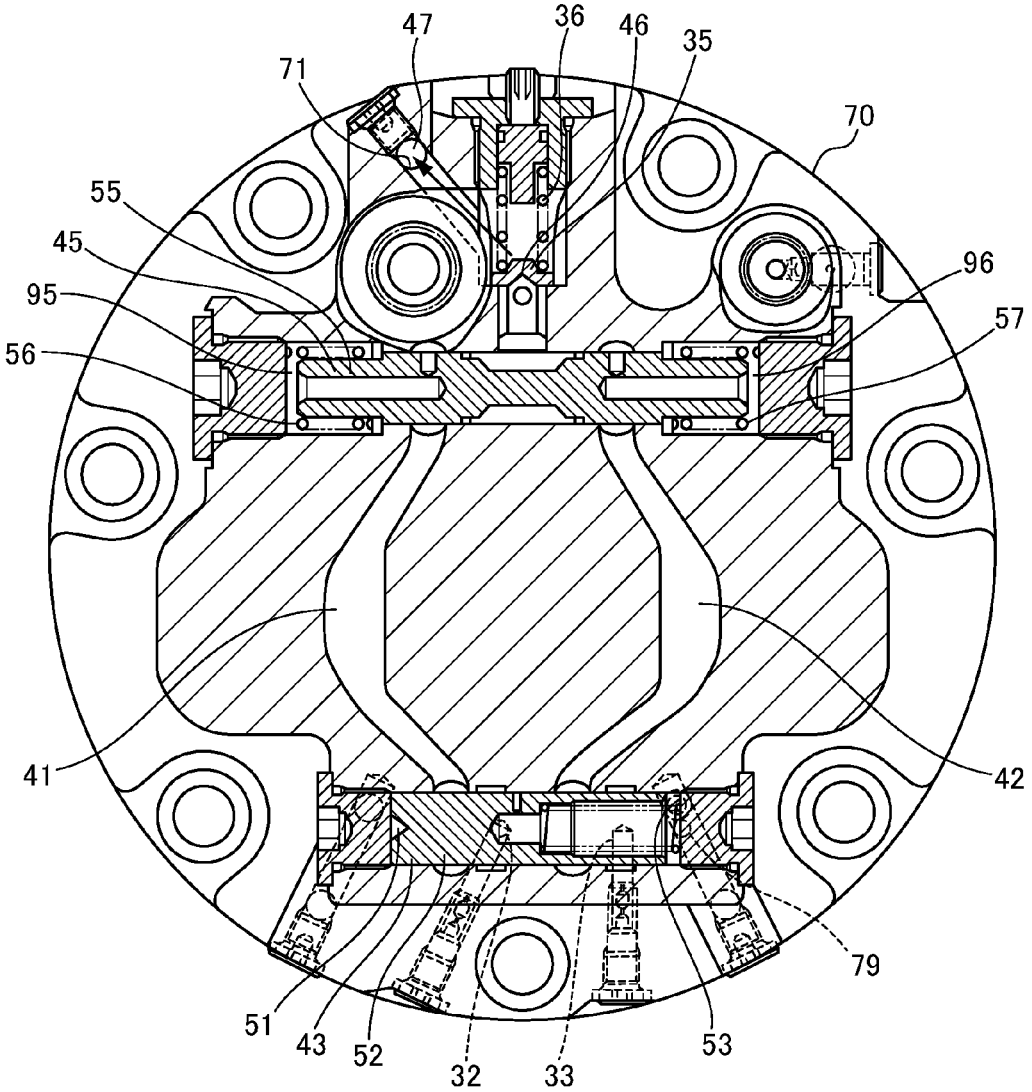
FIG. 3 is a cross-section view along line III-III in FIG. 2.

FIG. 3 is a cross-section view along line III-III in FIG. 2. As shown in FIG. 3, the speed switching valve 43 is interposed in the base plate 70. As explained above, the speed switching valve 43 switches the pilot pressure Ps that is led to the tilting actuators 31.

As shown in FIG. 3, when the pilot pressure Ps that is led to a pressure chamber 51 is lower than a predetermined value, a spool 52 of the speed switching valve 43 is retained in the low speed position a (refer to FIG. 1) by the biasing force of a spring 53. Thereby, the actuator passages 32 and 33 communicate with a through hole 79 of the in-motor drain passage 49.

On the other hand, when the pilot pressure Ps rises above a predetermined value, the spool 52 switches into the high speed position b (refer to FIG. 1) by moving in the right direction in FIG. 3 counter to the spring 53. Thereby, the actuator passages 32 and 33 communicate with the first and second motor passages 41 and 42.

As shown in FIG. 2, the brake mechanism 25 of the parking brake 20 includes three brake discs 21 that rotate together with the cylinder block 3, two friction plates 22 that are attached to the case 60, and a brake spring 26 that compresses the brake discs 21 to the friction plates 22.

The annular disc-shaped brake discs 21 are formed such that a plurality of teeth 21A are aligned in the circumferential direction on the inner peripheral edges of the brake discs 21. A spline 19 that extends in the axial direction is formed on the outer periphery of the cylinder block 3. The brake discs 21 rotate together with the cylinder block 3 by the engagement of the teeth 21A with the spline 19, and the brake discs 21 are movably supported in the rotation axis direction of the cylinder block 3.

As explained above, the brake release actuator 29 releases the braking of the parking brake 20 to counter the compressive force of the brake spring 26. The brake release actuator 29 includes an annular brake piston 27 that is movably supported in the axial direction on the case 60, and the brake release pressure chamber 28 to which the brake release pressure Pp that drives the brake piston 27 to counter the brake spring 26 is led. A plurality of spring receiving recesses 88 (refer to FIG. 5) in which the brake spring 26 is seated are formed on an end surface of the brake piston 27.

A collar 38 is attached to an inner wall of the case side part 60A. The brake piston 27 is slidably engaged into the inside of the collar 38. The brake release pressure chamber 28 is defined as an annular space between the brake piston 27 and the collar 38. The brake release pressure Pp is led from the brake release pressure passage 48 (refer to FIG. 1) formed in the base plate 70 to the brake release pressure chamber 28.

When stopping the travel of the vehicle, the brake discs 21 are pressed to the friction plates 22 by the biasing force of the brake spring 26 in a state in which the brake release pressure Pp that is led to the brake release pressure chamber 28 has decreased. Thereby, the rotation of the cylinder block 3 is braked by a frictional force acting on the brake discs 21.

On the other hand, when the vehicle is traveling, in accordance with an increase in the brake release pressure Pp, the brake piston 27 separates from the brake discs 21 to counter the biasing force of the brake spring 26 and the brake discs 21 separate from the friction plates 22. Thereby, the frictional force stops acting on the brake discs 21, and the braking of the cylinder block 3 is released.

As shown in FIG. 3, the low pressure selective valve 45 and the relief valve 46 are interposed in the base plate 70.

As explained above, the low pressure selective valve 45 switches to connect a low pressure side of the first and second motor passages 41 and 42 to the flushing passage 47.

When the piston motor 1 is stopped, during which the pressures in the first and second motor passages 41 and 42 are approximately equal, a spool 55 of the low pressure selective valve 45 is retained in the position c (refer to FIG. 1). Thereby, the communication between the first and second motor passages 41 and 42 and the flushing passage 47 is blocked.

During normal rotation of the piston motor 1 in which the pressure of the first motor passage 41 that is led to a pressure chamber 95 rises, the spool 55 switches to the position a (refer to FIG. 1) by moving in the right direction in FIG. 3. Thereby, the second motor passage 42 is connected to the flushing passage 47.

On the other hand, during reverse rotation of the piston motor 1 in which the pressure of the second motor passage 42 that is led to a pressure chamber 96 rises, the spool 55 switches to the position b (refer to FIG. 1) by moving in the left direction in FIG. 3. Thereby, the first motor passage 41 is connected to the flushing passage 47.

The relief valve 46 opens and closes the flushing passage 47 according to an outlet pressure of the low pressure selective valve 45. As shown in FIG. 3, when the outlet pressure of the low pressure selective valve 45 reaches a predetermined value or less, the spool 35 of the relief valve 46 is retained in a closed valve position.

As explained above, the flushing passage 47 is in communication with the casing chamber 58 and leads hydraulic oil that flows out into the casing chamber 58. If the outlet pressure of the low pressure selective valve 45 rises above a predetermined value, the relief valve 46 is opened by movement of the spool 35 in the upwards direction in FIGS. 2 and 3 counter to the biasing force of a spring 36. When the relief valve 46 is opened in this way to open the flushing passage 47, as explained above, hydraulic oil that is discharged from the low pressure selective valve 45 is led to the casing chamber 58 through the flushing passage 47 as shown by a flow line (dash-dot-dot line) D in FIG. 2.

In accordance with the rotation of the motor mechanism 40, the low pressure selective valve 45 and the relief valve 46 are each set to open by a pressure generated on the low pressure side of the first and second motor passages 41 and 42. Thereby, in accordance with the rotation of the motor mechanism 40, hydraulic oil that is extracted from one of the first and second motor passages 41 and 42 flows into the casing chamber 58 through the flushing passage 47. The casing chamber 58 is sufficiently cooled by this hydraulic oil regardless of the operating conditions.

As shown by the dashed lines in FIG. 2, the flushing passage 47 is defined by a base-side flushing through hole 71 that is formed in the base plate 70 and a case-side flushing through hole 61 that is formed in the case 60.

Figure 4:
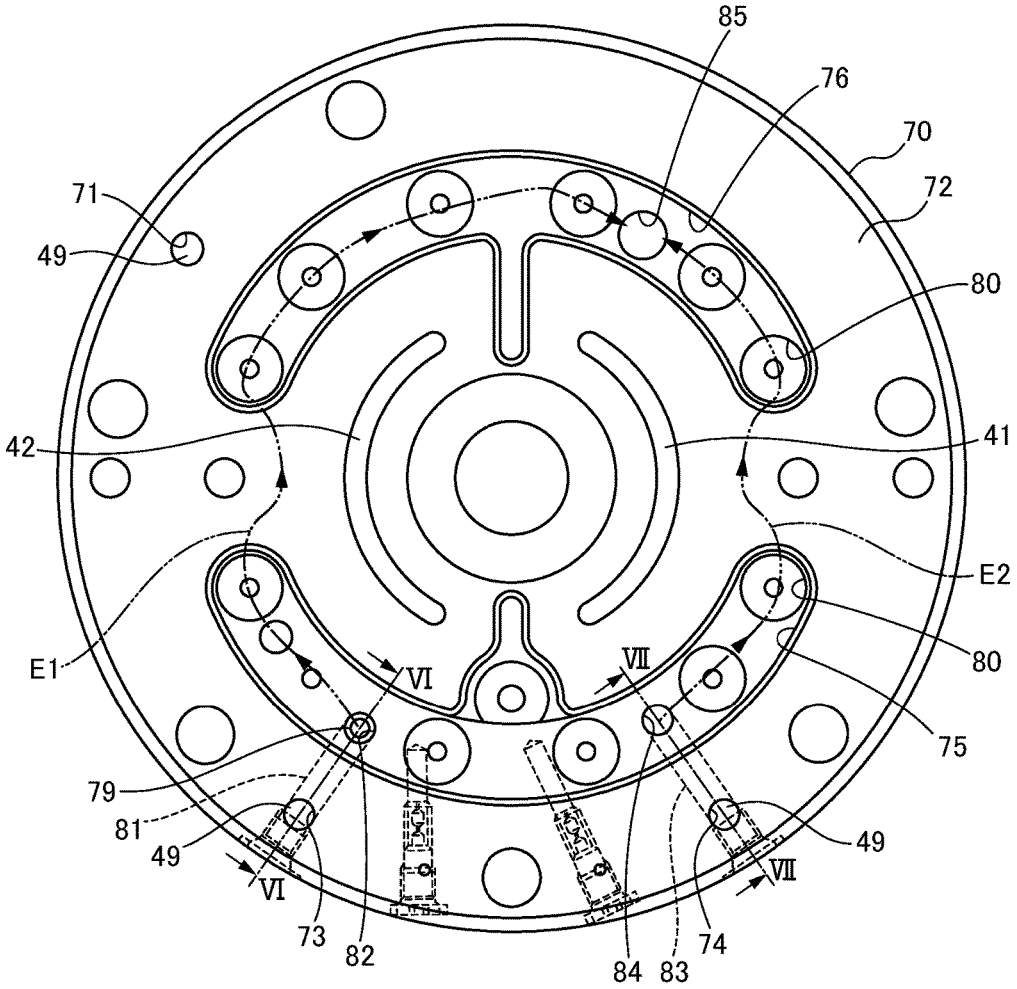
FIG. 4 is a rear surface view of a base plate along line IV-IV in FIG. 2.

FIG. 4 is a view along line IV-IV in FIG. 2. As shown in FIG. 4, the base-side flushing through hole 71 opens at a flange end face 72 of the base plate 70.

Figure 5:
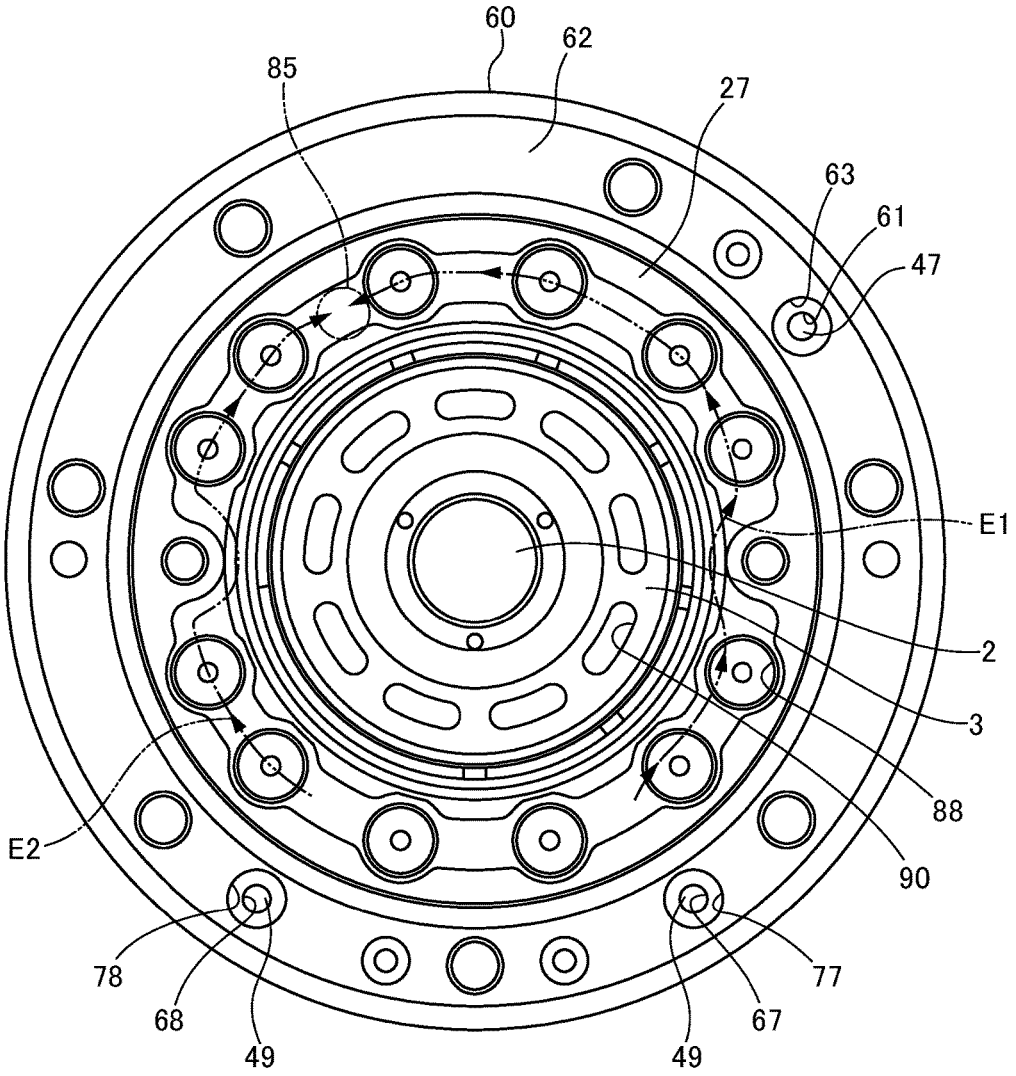
FIG. 5 is a front surface view of a casing along line V-V in FIG. 2.

FIG. 5 is a view along line V-V in FIG. 2. As shown in FIG. 5, the case-side flushing through hole 61 opens at a flange end face 62 of the case 60. An annular recess 63 is formed around the case-side flushing through hole 61. A seal ring is interposed between the annular recess 63 and the flange end face 72 of the base plate 70 to create a seal therebetween.

The passage length of the flushing passage 47 is arbitrarily set and is configured such that the flow amount of hydraulic oil that is extracted from one of the first and second motor passages 41 and 42 to the flushing passage 47 is appropriately obtained. Thereby, during operation in which the temperature of the hydraulic oil is low, the flow path resistance imparted by the flushing passage 47 to the flow of the hydraulic oil increases in accordance with an increase in the viscosity of the hydraulic oil. Thus, the flow amount of the hydraulic oil decreases adequately. On the other hand, if the temperature of the hydraulic oil rises, the flow path resistance imparted by the flushing passage 47 to the flow of the hydraulic oil decreases in accordance with a decrease in the viscosity of the hydraulic oil. Thus, the flow amount of the hydraulic oil gradually increases and an increase in the temperature of the hydraulic oil is suppressed.

As shown in FIG. 2, an outlet 47A of the flushing passage 47 opens at an inner wall surface of the case side part 60A. The outlet 47A is positioned near the case bottom part 60B, and opens facing an outer peripheral surface 7A of the swash plate 7.

The outlet 47A is oriented toward a swash plate rear space 64 that is defined between the swash plate 7 and the case bottom part 60B, such that hydraulic oil that flows out from the outlet 47A is led to the swash plate rear space 64. Thereby, hydraulic oil that flows from the outlet 47A into the casing chamber 58 flows along the swash plate 7, an inner wall surface of the case bottom part 60B, and the bearing 17, and thus the case bottom part 60B and the bearing 17 are effectively cooled.

The flushing passage 47 can be formed so as to pass near the bearing 17 and the oil seal 37 within the case bottom part 60B, so that heat of the case bottom part 60B is absorbed by the hydraulic oil flowing through the flushing passage 47 to cool the bearing 17 and the oil seal 37, which can easily overheat.

The casing chamber 58 is partitioned into a swash plate housing chamber 58A and a brake front chamber 58B by the brake discs 21 and the friction plates 22 of the parking brake 20. The outlet 47A of the flushing passage 47 opens into the swash plate housing chamber 58A that houses the swash plate 7. Hydraulic oil that flows in from the outlet 47A is led to the swash plate rear space 64.

Thereby, hydraulic oil that flows from the outlet 47A into the casing chamber 58 flows along the swash plate 7, the inner wall surface of the case bottom part 60B, and the bearing 17, and thus the case bottom part 60B and the bearing 17 are effectively cooled.

As explained above, hydraulic oil that flows into the casing chamber 58 is returned to the tank via the in-motor drain passage 49 and the out-of-motor drain passage.

The in-motor drain passage 49 is defined by first and second drain through holes 67 and 68 (refer to FIG. 5) formed in the case side part 60A.

The first and second drain through holes 67 and 68 open at the inner wall surface of the case side part 60A as drain inlets that allow hydraulic oil to flow out from the casing chamber 58 to the in-motor drain passage 49. An inlet 67A, which is an opening end of the first drain through hole 67, opens into the swash plate housing chamber 58A that houses the swash plate 7 and is formed at a position opposing the outlet 47A with the swash plate 7 therebetween. An opening end (not illustrated) of the second drain through hole 68 is also similarly formed at a position opposing the outlet 47A with the swash plate 7 therebetween.

In this way, hydraulic oil in the casing chamber 58 that heads from the outlet 47A to the first and second drain through holes 67 and 68 passes through the swash plate housing chamber 58A that houses the swash plate 7 and does not cross the brake discs 21 and the friction plates 22 of the parking brake 20. Therefore, resistance on the hydraulic oil by the rotating brake discs 21 is suppressed, and the flow amount of hydraulic oil that circulates through the casing chamber 58 is sufficient.

As shown in FIG. 5, the first and second drain through holes 67 and 68 that define the in-motor drain passage 49 open at the flange end surface 62 of the case 60. Annular recesses 77 and 78 are respectively formed around the first and second drain through holes 67 and 68. Seal rings are respectively interposed between the annular recesses 77 and 78 and the flange end surface 72 of the base plate 70 to create a seal therebetween.

As shown in FIG. 4, one end of each of through holes 73 and 74 that connect to the first and second drain through holes 67 and 68 opens at the flange end face 72 of the base plate 70. Drain grooves 75 and 76 also open at the flange end face 72 of the base plate 70. The drain grooves 75 and 76 extend in a circular arc so as to face the brake piston 27. A plurality of spring receiving recesses 80 in which the brake spring 26 is seated are formed on the inner walls of the drain grooves 75 and 76.

Figure 6:
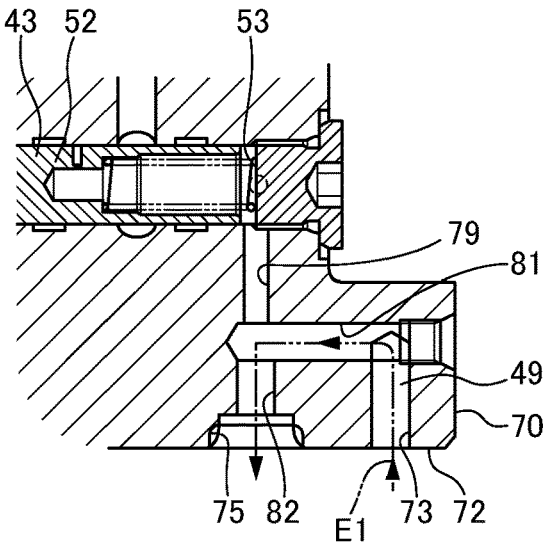
FIG. 6 is a cross-section view of a base plate along line VI-VI in FIG. 4.

FIG. 6 is a cross-section view along line VI-VI in FIG. 4. As shown in FIG. 6, the through hole 73 is in communication with the drain groove 75 via through holes 81 and 82. The through hole 82 is formed coaxially with the through hole 79 that is connected to the speed switching valve 43.

Figure 7:
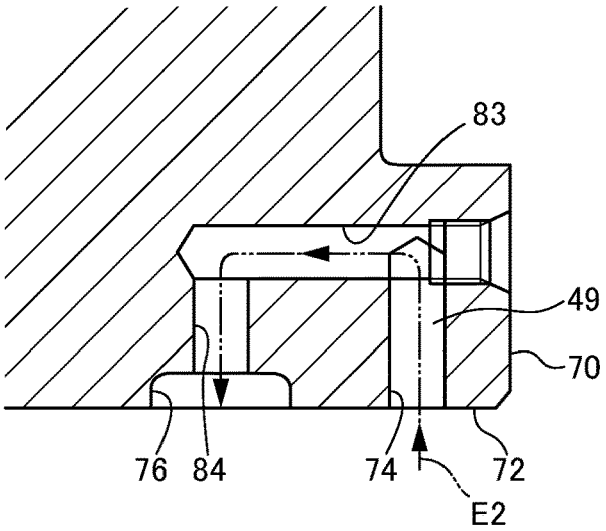
FIG. 7 is a cross-section view of a base plate along line VII-VII in FIG. 4.

FIG. 7 is a cross-section view along line VII-VII in FIG. 4. As shown in FIG. 7, the through hole 74 is in communication with the drain groove 76 via through holes 83 and 84.

A through hole 85 that defines the in-motor drain passage 49 opens at the drain groove 76. One end of the through hole 85 opens at an outer wall surface of the base plate 70. The out-of-motor drain passage is connected to the one end of the through hole 85.

As shown by flow lines (dash-dot-dot lines) E1 and E2 in FIGS. 6 and 7, hydraulic oil in the casing chamber 58 flows out through the in-motor drain passage 49. In the in-motor drain passage 49, two hydraulic oil flows E1 and E2 are created from the case 60 across the base plate 70 by the first and second drain through holes 67 and 68, and thus a sufficient flow path cross-section area for the hydraulic oil that flows out from the casing chamber 58 is secured. Thereby, pressure increases in the casing chamber 58 are suppressed and the operation of the parking brake 20 is maintained. The constitution of the in-motor drain passage 49 is not limited thereto, and the in-motor drain passage 49 can be constituted to create three or more hydraulic oil flows by increasing the number of drain through holes.

According to the above-described embodiments, the following operational effects are achieved.

The piston motor 1 includes the motor mechanism 40 that rotates by hydraulic liquid that is supplied/discharged from a hydraulic liquid pressure source through one of the first motor passage 41 and the second motor passage 42. The piston motor 1 also includes the casing 59 that defines the casing chamber 58 which accommodates the motor mechanism 40, and the flushing passage 47 that is in communication with the casing chamber 58 and extracts a portion of hydraulic liquid from a low pressure side among the first motor passage 41 and the second motor passage 42 and leads it to the casing chamber 58 (refer to FIGS. 1 to 7).

According to the above-described constitution, in accordance with the rotation of the motor mechanism 40, hydraulic liquid that is extracted from the low pressure side of the first and second motor passages 41 and 42 to the flushing passage 47 flows through the casing chamber 58 to absorb heat from the casing 59. Thereby, the casing 59 is sufficiently cooled regardless of the operating conditions of the hydraulic motor.

The motor mechanism 40 includes the swash plate 7 provided within the casing chamber 58, the plurality of pistons 6 that move back and forth following the swash plate 7 by hydraulic liquid pressure, the cylinder block 3 that rotates relative to the swash plate 7 by the back-and-forth motion of the pistons 6, and the output shaft 2 that outputs the rotation of the cylinder block 3. The casing 59 includes the base plate 70 in which the first motor passage 41 and the second motor passage 42 are provided, and the case 60 that supports the output shaft 2 and defines the casing chamber 58 together with the base plate 70. The flushing passage 47 is defined by the base-side flushing through hole 71 that is formed in the base plate 70 and the case-side flushing through hole 61 that is formed in the case 60 and is in communication with the base-side flushing through hole 71 (refer to FIGS. 1 to 5).

According to the above-described constitution, the flushing passage 47 extends across the base plate 70 and the case 60, and enables hydraulic liquid that has flowed separately from the first and second motor passages 41 and 42 to flow into a back part of the casing chamber 58 (near the case bottom part 60B). Thereby, the case 60 is sufficiently cooled in the case that an area of the case 60 (the case bottom part 60B) that is separated from the base plate 70 is heated by the reduction gear.

The piston motor 1 includes the brake discs 21 that rotate together with the cylinder block 3, and the drain passage 39 that discharges hydraulic liquid of the casing chamber 58. The swash plate housing chamber 58A which houses the swash plate 7 and the brake front chamber 58B that is partitioned from the swash plate housing chamber 58A by the brake discs 21 are defined in the casing chamber 58. The outlet 47A of the flushing passage 47 and the inlet 67A of the drain passage 39 each open into the swash plate housing chamber 58A (refer to FIGS. 1 to 5).

According to the above-described constitution, hydraulic liquid in the casing chamber 58 that heads from the outlet 47A of the flushing passage 47 toward the inlet 67A of the drain passage 39 passes through the swash plate housing chamber 58A which houses the swash plate 7 and does not cross the brake discs 21. Therefore, resistance on the hydraulic liquid by the rotating brake discs 21 is reduced, and the flow amount of hydraulic liquid that circulates through the casing chamber 58 is sufficient.

The drain passage 39 is defined by the plurality of drain through holes 67 and 68 that open into the casing chamber 58 (refer to FIGS. 1 to 5).

According to the above-described constitution, in the drain passage 39, the plurality of hydraulic liquid flows E1 and E2 are created by the plurality of drain through holes 67 and 68, and thus a sufficient flow path cross-section area for the hydraulic liquid that flows out from the casing chamber 58 is secured. Thereby, pressure increases in the casing chamber 58 are suppressed and the operation of the brake mechanism 25 (the parking brake 20) which imparts a frictional force on the brake discs 21 is maintained.

Embodiments of this invention were described above, but the above embodiments are merely examples of applications of this invention, and the technical scope of this invention is not limited to the specific constitutions of the above embodiments.

This application claims priority based on Japanese Patent Application No. 2012-036218 filed with the Japan Patent Office on Feb. 22, 2012, the entire contents of which are incorporated into this specification.

The embodiments of this invention in which an exclusive property or privilege is claimed are defined as follows:

The invention claimed is:

1. A hydraulic motor system equipped with a hydraulic motor that is configured to rotate by hydraulic liquid that is supplied/discharged from a hydraulic liquid pressure source through one of a first motor passage and a second motor passage, comprising:

a casing that defines a casing chamber which accommodates the hydraulic motor; and a flushing passage that is in communication with the casing chamber, is connected between the casing chamber and the first motor passage and between the casing chamber and the second motor passage, and is configured to extract a portion of the hydraulic liquid from a low pressure side among the first motor passage and the second motor passage and to provide the portion of the hydraulic liquid to the casing chamber, such that when a pressure in the first motor passage is lower than a pressure in the second motor passage, the flushing passage extracts the portion of the hydraulic liquid from the first motor passage, and when the pressure in the second motor passage is lower than the pressure in the first motor passage, the flushing passage extracts the portion of the hydraulic liquid from the second motor passage, wherein the hydraulic motor includes:

a swash plate provided in the casing chamber;

a plurality of pistons that are configured to move back and forth following the swash plate by hydraulic liquid pressure;

a cylinder block that is configured to rotate relative to the swash plate by the back-and-forth motion of the pistons; and an output shaft that is configured to output the rotation of the cylinder block, wherein the casing includes:

a base plate in which the first motor passage and the second motor passage are provided; and a case that supports the output shaft and defines the casing chamber together with the base plate, wherein the flushing passage is defined by:

a base-side flushing through hole that is formed in the base plate; and a case-side flushing through hole that is formed in the case, a one end of the case-side flushing through hole being in communication with the base-side flushing through hole, and another end of the case-side flushing through hole being in communication with the casing chamber, wherein the hydraulic liquid extracted from the flushing passage and guided to the casing chamber is discharged through a drain passage, and wherein the drain passage includes a drain through hole that is formed in the case, a one end of the drain through hole being in communication with the casing chamber so as to oppose the another end of the case-side flushing through hole.

2. The hydraulic motor system according to claim 1, wherein the base-side flushing through hole is formed to pass through the base plate in axial direction.

3. A hydraulic motor system equipped with a hydraulic motor that is configured to rotate by hydraulic liquid that is supplied/discharged from a hydraulic liquid pressure source through one of a first motor passage and a second motor passage, comprising:

a casing that defines a casing chamber which accommodates the hydraulic motor;

a flushing passage that is in communication with the casing chamber, is connected between the casing chamber and the first motor passage and between the casing chamber and the second motor passage, and is configured to extract a portion of the hydraulic liquid from a low pressure side among the first motor passage and the second motor passage and to provide the portion of the hydraulic liquid to the casing chamber, such that when a pressure in the first motor passage is lower than a pressure in the second motor passage, the flushing passage extracts the portion of the hydraulic liquid from the first motor passage and when the pressure in the second motor passage is lower than the pressure in the first motor passage, the flushing passage extracts the portion of the hydraulic liquid from the second motor passage;

a brake disc; and a drain passage that is configured to discharge hydraulic liquid of the casing chamber, wherein the hydraulic motor includes:

a swash plate provided in the casing chamber;

a plurality of pistons that are configured to move back and forth following the swash plate by hydraulic liquid pressure;

a cylinder block that is configured to rotate relative to the swash plate by the back-and-forth motion of the pistons, the cylinder block being configured to rotate together with the brake disc; and an output shaft that is configured to output the rotation of the cylinder block, wherein the casing includes:

a base plate in which the first motor passage and the second motor passage are provided; and a case that supports the output shaft and defines the casing chamber together with the base plate, wherein the flushing passage is defined by:

a base-side flushing through hole that is formed in the base plate; and a case-side flushing through hole that is formed in the case and is in communication with the base-side flushing through hole, wherein a swash plate housing chamber that houses the swash plate and a brake front chamber that is partitioned from the swash plate housing chamber by the brake disc are defined in the casing chamber, and wherein an outlet of the flushing passage and an inlet of the drain passage each open into the swash plate housing chamber.

4. The hydraulic motor system according to claim 3, wherein the drain passage is defined by a plurality of drain through holes that open into the casing chamber.

5. A hydraulic motor system equipped with a hydraulic motor that is configured to rotate by hydraulic liquid that is supplied/discharged from a hydraulic liquid pressure source through one of a first motor passage and a second motor passage, comprising:

a casing that defines a casing chamber which accommodates the hydraulic motor;

a low pressure selective valve connected to an end of the first motor passage and an end of the second motor passage, the low pressure selective valve comprising a spool movable linearly within a space in the casing, the spool including a groove; and a flushing passage connected between the low pressure selective valve and the casing chamber and in fluid communication with a portion of the space in the casing in which the groove is located, wherein the first motor passage and the second motor passage are in fluid communication with the space in the casing, wherein the first motor passage is in fluid communication with a first chamber at a first end of the spool and exerts pressure against the first end of the spool, and the second motor passage is in fluid communication with a second chamber at a second end of the spool opposite the first end and exerts pressure against the second end of the spool, wherein the low pressure selective valve is configured to switch according to a pressure in the first motor passage and the second motor passage, such that one of the first motor passage and the second motor passage having a lower pressure is connected to the flushing passage via the groove in the spool to provide hydraulic liquid from the hydraulic liquid pressure source to the casing chamber, wherein the hydraulic motor includes:

a swash plate provided in the casing chamber;

a plurality of pistons that are configured to move back and forth following the swash plate by hydraulic liquid pressure;

a cylinder block that is configured to rotate relative to the swash plate by the back-and-forth motion of the pistons; and an output shaft that is configured to output the rotation of the cylinder block, wherein the casing includes:

a base plate in which the first motor passage and the second motor passage are provided; and a case that supports the output shaft and defines the casing chamber together with the base plate, wherein the flushing passage is defined by a base-side flushing through hole that is formed in the base plate; and a case-side flushing through hole that is formed in the case, a one end of the case-side flushing through hole being in communication with the base-side flushing through hole, and another end of the case-side flushing through hole being in communication with the casing chamber, wherein the hydraulic liquid extracted from the flushing passage and guided to the casing chamber is discharged through a drain passage, and wherein the drain passage includes a drain through hole that is formed in the case, a one end of the drain through hole being in communication with the casing chamber so as to oppose to the another end of the case-side flushing through hole.

6. The hydraulic motor system according to claim 5, wherein the first motor passage is in fluid communication with the space in the casing via a first opening and the second motor passage is in fluid communication with the space in the casing via a second opening, and a length of the groove in the spool is less than a distance between the first opening and the second opening.

* * * * *